US007153081B2

(12) United States Patent
Watanabe

(10) Patent No.: US 7,153,081 B2
(45) Date of Patent: Dec. 26, 2006

(54) SELF-PROPELLED CARRIAGE

(75) Inventor: Haruhiro Watanabe, Komaki (JP)

(73) Assignee: Daifuku Co., Ltd., Osaka (JP)

( * ) Notice: Subject to any disclaimer, the term of this patent is extended or adjusted under 35 U.S.C. 154(b) by 361 days.

(21) Appl. No.: 10/624,168

(22) Filed: Jul. 21, 2003

(65) Prior Publication Data

US 2004/0016581 A1 Jan. 29, 2004

(30) Foreign Application Priority Data

Jul. 22, 2002 (JP) ..... 2002-211862

(51) Int. Cl.
*B60P 1/00* (2006.01)

(52) U.S. Cl. ..... 414/507; 414/343; 414/509; 414/809; 414/813; 414/940

(58) Field of Classification Search ..... 414/643, 414/343, 389, 507, 509, 809, 812, 813, 940, 414/463; 296/100.01, 100.03, 216.01, 216.04; 180/89.13, 89.18; 220/345.1, 351, 810, 811, 220/816, 817, 820, 826
See application file for complete search history.

(56) References Cited

U.S. PATENT DOCUMENTS 3,190,473 A * 6/1965 Loef ..... 414/541
3,643,825 A * 2/1972 Zane, Jr. ..... 414/607
3,757,977 A * 9/1973 Brudi et al. ..... 414/607
3,850,322 A * 11/1974 Miles et al. ..... 414/607
4,128,183 A * 12/1978 Finlayson ..... 414/666
4,309,758 A * 1/1982 Halsall et al. ..... 701/23
5,599,155 A * 2/1997 Rohm et al. ..... 414/283
5,653,569 A * 8/1997 Sears ..... 414/607
6,394,736 B1 * 5/2002 Derby et al. ..... 414/583

* cited by examiner

*Primary Examiner*—Patrick Mackey
*Assistant Examiner*—Michael Lowe
(74) *Attorney, Agent, or Firm*—D. Peter Hochberg; Sean Mellino

(57) ABSTRACT

An article transfer method using a self-propelled carriage capable of supporting an article and travelling along a fixed path is provided in which an article supporting body forming a final operating section is turned without performing lateral movement and with making little protrusion toward the article handling section, by combining longitudinal movement of a movable body with respect to a vehicle body and turning movement of a turnable body with respect to the movable body. As a result, means for performing lateral movement of the article supporting body can be omitted, and hence the overall device can be constituted in a simple and inexpensive manner.

2 Claims, 12 Drawing Sheets

SELF-PROPELLED CARRIAGE

BACKGROUND OF THE INVENTION

1. Field of the Invention

The present invention relates to an article transfer method using a self-propelled carriage capable of travelling along a fixed path and holding articles, and to a self-propelled carriage.

2. Description of the Related Art

In the prior art, an article carrying vehicle as disclosed in Japanese Unexamined Patent Publication No. 10-139172 has been proposed as a device of this kind. This article carrying vehicle comprises a laterally sliding table capable of moving in lateral directions (vehicle width directions), and a longitudinally sliding table capable of moving in forward and rearward directions (longitudinal direction of a vehicle) provided on the laterally sliding table. Furthermore, a turning platform is provided on the longitudinally sliding table to be rotatable about a vertical axis, and a fork device is provided on the revolving platform to be vertically movable. Furthermore, an upper cover portion for covering articles mounted on an article transferring section is also provided on the vehicle, and shutters are provided on either side of the upper cover section in the lateral direction of the vehicle body.

When transferring an article by using an article carrying vehicle of this kind, firstly, the article carrying vehicle is caused to travel along a fixed path and is halted alongside a station, and in this state, the station side shutter is opened. Thereupon, the laterally sliding table is moved to the station side, so as to move the longitudinally sliding table, the revolving platform and the fork device in an integrated fashion. The fork device is moved upward, and then the revolving platform is turned to cause the fork device to turn to be movable in lateral directions. Thereupon, the longitudinally sliding table is moved forward or rearward, thereby correcting the longitudinal-directional position of the fork device with respect to the station.

By moving the fork device to project, and then to lower, the article is transferred to the station side. Subsequently, the fork device is retracted, and then the revolving platform is turned to cause the fork device to be in a longitudinal orientation. The laterally sliding table is moved over the vehicle body, and then the shutter is closed, thereby completing the transfer of the article to the station. As for loading an article to the article carrying vehicle, it can be performed in a similar manner but with a different timing for vertically moving the fork device.

However, according to the prior art constitution described above, the fork device, which is the final operating section, is caused to move laterally and longitudinally, and turn, with respect to the vehicle body, and in order to achieve lateral and longitudinal movement in this case, it is necessary to adopt structures respectively comprising motors, guiding means (guide rails, or the like,) base members, and the like, and hence the overall structure becomes complicated and expensive, in addition to which, the operating time (work time) becomes longer and the control tasks become more complex.

SUMMARY OF THE INVENTION

Therefore, a first object of the present invention is to provide an article transfer method using a self-propelled carriage, wherein articles can be transferred without performing lateral movement of an article supporting body forming a final operating section.

Moreover, a second object of the present invention is to provide a self-propelled carriage which is readily capable of realizing the article transfer method.

In order to achieve the first object described above, the article transfer method for a self-propelled carriage according to the present invention is a method of transferring articles to/from an article handling section, using a self-propelled carriage capable of travelling along a fixed path and comprising a movable body capable of moving in a longitudinal direction with respect to a carriage body, a turnable body capable of turning about a vertical axis with respect to the movable body, the turnable body being mounted thereover with an article supporting body, wherein this method comprises the steps of: halting the self-propelled carriage alongside an article handling section; performing initial turning of the turnable body about the vertical axis so as to cause the front end of the article supporting body to face the article handling section; moving the movable body whilst turning the turnable body about the vertical axis, so that the front end of the article supporting body is positioned substantially right at a lateral side of the carriage body so as to face the article handling section; performing transfer of an article between the article supporting body and the article handling section; and causing the article supporting body to perform a reverse operation so as to be accommodated on the carriage body.

With this construction of the present invention, it is possible to perform turning of the article supporting body without performing lateral movement of the article supporting body forming the final operating section, and with little protrusion toward the article handling section side, by means of a combination of longitudinal movement of the movable body with respect to the carriage body and turning movement of the turnable body with respect to the movable body. Hence, means for performing lateral movement of the article supporting body can be omitted, and the overall device can be constituted in a simple and inexpensive manner.

In order to achieve the first object described above, provided as another article transfer method using a self-propelled carriage according to the present invention is a method of transferring articles to/from an article handling section, using a self-propelled carriage capable of travelling along a fixed path and comprising a movable body capable of moving in a longitudinal direction with respect to the vehicle body, a turnable body capable of turning about a vertical axis with respect to the movable body, and an article supporting body capable of extending and retracting with respect to the turnable body, wherein the method comprises the steps of: halting the self-propelled carriage alongside the article handling section; causing the article supporting body to make an extension movement; performing initial turning of the turnable body about the vertical axis so as to cause the front end of the article supporting body to face the article handling section; moving the movable body whilst performing intermediate turning of the turnable body about the vertical axis, and causing the supporting body to make a retracting movement; performing final turning of the turnable body about the vertical axis, so that the front end of the article supporting body is positioned substantially right at a lateral side of the carriage body so as to face the article handling section; performing transfer of an article between the article supporting body and the article handling section; and causing the article supporting body to perform a reverse operation so as to be accommodated on the carriage body.

According to this further embodiment of the present invention, it is possible to perform turning of the article supporting body without performing lateral movement of the article supporting body forming the final operating section, and with little protrusion toward the article handling section side, by means of a combination of longitudinal movement of the movable body with respect to the carriage body, turning movement of the turnable body with respect to the movable body, and extending and retracting movement of the article supporting body with respect to the turnable body. Hence, means for performing lateral movement of the article supporting body can be omitted, and the overall device can be constructed in a simple and inexpensive manner.

In order to achieve the second object described above, the self-propelled carriage according to the present invention is a self-propelled carriage comprising a movable body capable of moving in a longitudinal direction with respect to a carriage body, and moving means, the movable body comprising a turnable body capable of turning about a vertical axis and turning means, the turnable body being mounted thereover with an article supporting body thereon, wherein the movable body performs a longitudinal movement whilst the turning body performs a turning movement at least partially in a synchronised manner.

According to this embodiment of the present invention, the movable body can be moved in the longitudinal direction with respect to the carriage body, by operation of the moving means, and furthermore, the turnable body can be turned about a vertical axis with respect to the movable body, by operation of the turning means, it being possible to perform the longitudinal movement of the movable body partially in a synchronised manner with the turning movement of the turnable body, by operating the turning means. Thereby, the article transfer methods according to the first and second aspects of the invention can be achieved readily.

In a preferred embodiment of the self-propelled carriage according to the present invention, a cover member for covering the article supporting body is provided on top of the vehicle body, in such a manner that at least a portion thereof is turnable in unison with the turnable body.

According to this preferred embodiment, it is possible to cover and protect an article carried on the article supporting body, and by turning at least a portion of the cover member in unison with the turnable body, it is possible to perform transfer of the article by means of the article supporting body, without any obstruction.

In another preferred embodiment of the self-propelled carriage according to the present invention, an article supporting body is a fork device capable of being extended and retracted in forward and backward directions.

According to this preferred embodiment, with the fork operation of the fork device, articles can be transferred to and from the article handling section always in a preferable manner.

DESCRIPTION OF THE PREFERRED EMBODIMENTS

Figure 1:
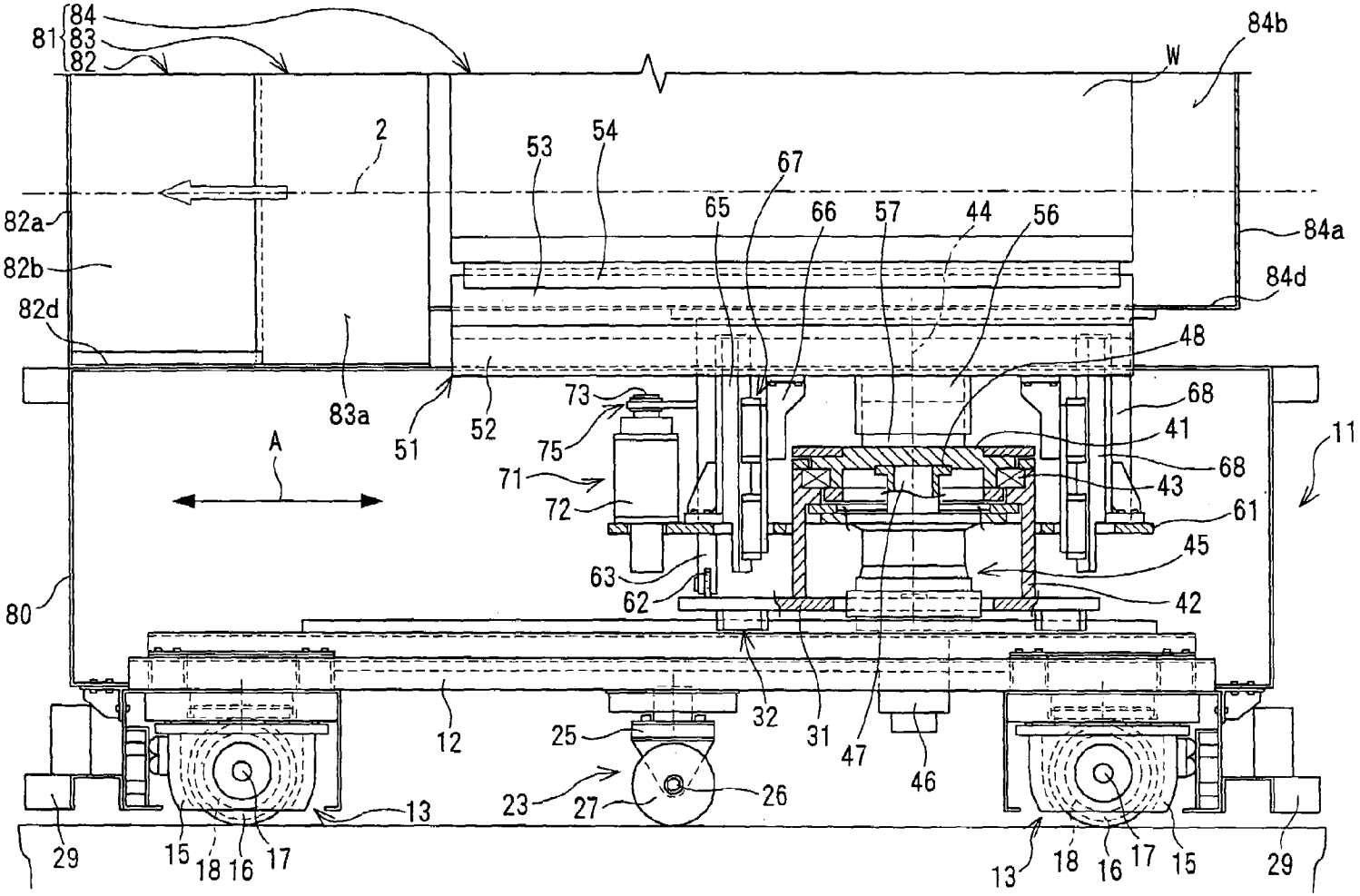
FIG. 1 is a partially cutaway side view of a self-propelled carriage in a travelling state according to a first embodiment of the present invention.
Figure 2:
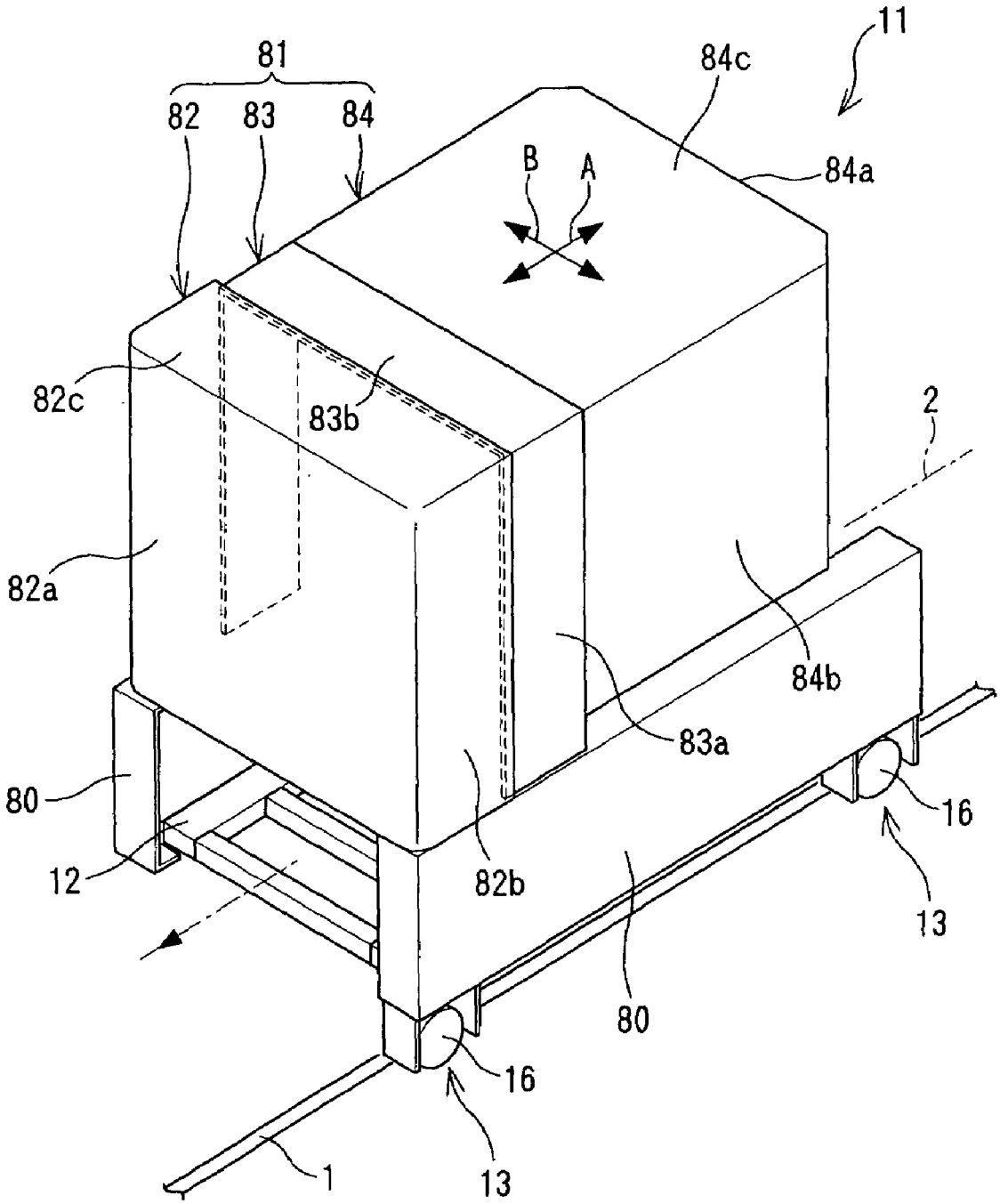
FIG. 2 is a schematic perspective view of the self-propelled carriage.
Figure 3:
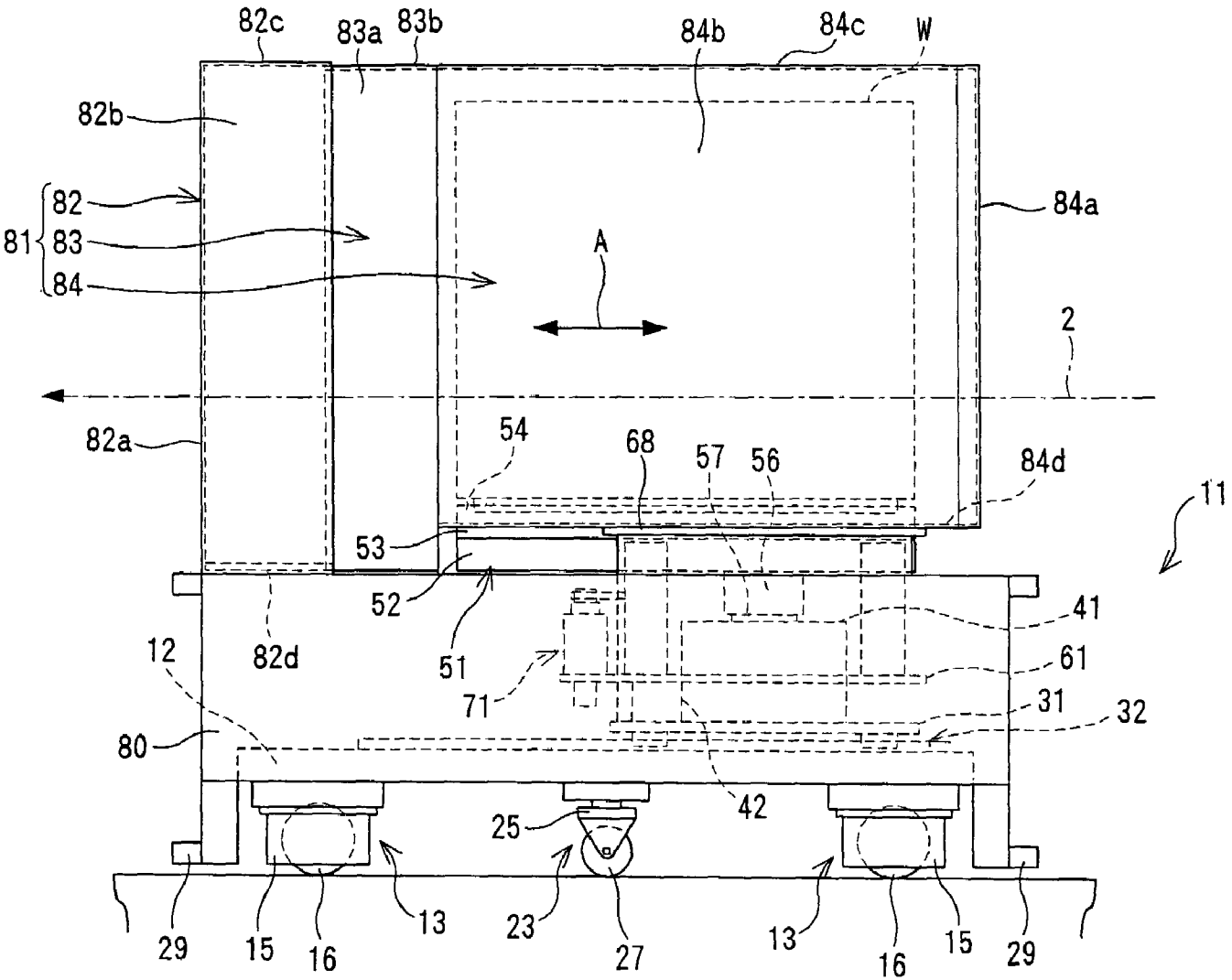
FIG. 3 is a side view of the self-propelled carriage.

Below, a case where a first embodiment of the present invention is applied to a trackless type self-propelled carriage is described with reference to FIG. 1 to FIG. 10.

As shown in FIG. 1 to FIG. 7, the self-propelled carriage 11 is a vehicle that is capable of travelling along a fixed path 2 by following an induction belt 1, and a vehicle body 12 thereof is formed in a rectangular planar frame shape having longer sides in the longitudinal direction. Driving wheel devices 13 are provided respectively on the front and rear end sections on one lateral side of the lower portion of the vehicle body 12, and a driven wheel device 23 is provided in a single location, centrally with respect to the front and rear ends, on the other lateral side of the vehicle body 12.

The two driving wheel devices 13 respectively comprise a wheel bracket 15 which is rotatable about a vertical axis by means of being supported via a bearing 14 on the vehicle body 12, and, provided on this wheel bracket 15, a driving wheel 16, and a direct axial drive type travel motor 18 corresponding to a wheel axle 17 of the driving wheel 16, and the like. Furthermore, there are also provided on the vehicle body 12 angle detectors (angle detecting means) 19 for detecting the steering angle (turning angle) of the driving wheels 16 by detecting the angle of rotation of the wheel bracket 15, taking the direction of travel of the self-propelled carriage 11 as 0°.

Moreover, the driving wheel devices 13 are provided with guide sensors 20 facing downwards for detecting the induction belt 1, at the front and rear of the inner side of the wheel bracket 15 which rotate with driving wheels 16, in other words, at the front and rear of the inner side of the driving wheels 16, in such a manner that their orientation changes in unison with the driving wheels 16. Consequently, the guide sensors 20 function as induction belt detecting means for detecting the induction belt 1. Here, the guide sensors 20 are formed by a plurality of reflection type photoelectric switches aligned in the lateral direction of the self-propelled carriage 11.

The driven wheel device 23 comprises a wheel bracket 25 capable of rotating about a vertical axis by means of being supported on the vehicle body 12 via a bearing 24, and a driven wheel 27 is provided in a freely movable fashion via a wheel axle 26 on the wheel bracket 25. Bumpers 29 are provided respectively on the front face and rear face of the vehicle body 12 in order to alleviate shocks in the case of contact with another self-propelled carriage 11 or an obstacle.

A movable body 31 and moving means 33 are provided on the vehicle body 12, movable in the forward and rearward direction (longitudinal direction of the vehicle) A with respect to the vehicle body 12. In other words, the movable body 31 has a rectangular planar shape and is constructed in such a manner that it can move in the longitudinal direction A above the vehicle body 12, by means of a pair of linear guide mechanisms 32 disposed on the right and left sides (in the width direction of the vehicle B).

The moving means 33 is constituted by a moving device (motor with reducing gear) 34 provided on the front portion and closer to the right-hand side of the vehicle body 12, a driving wheel 36 coupled to upwardly facing output shaft 35 of the moving device 34, a supporting axle 37 provided adjustably in position in the longitudinal direction on the rear portion of the vehicle body 12 closer to the right-hand side thereof, a driven wheel 38 provided in a freely turnable manner on the supporting axle 37, and an endless turning member (timing belt, or the like) 39 wound between the respective wheels 36, 38. The endless turning member 39 is coupled to the movable body 31 at appropriate points C.

Consequently, by forward or reverse driving of the moving device 34, the driving wheel 36 is caused to rotate forwards or in reverse, via the output shaft 35, and the endless turning member 39 wound between the driving wheel 36 and the driven wheel 38 is caused to rotate forward or in reverse, thereby allowing the movable body 31 to move in the longitudinal direction A whilst being guided by the linear guide mechanisms 32.

A turnable body 41 capable of being turned about a vertical axis 44, and turning means 45, are provided on the movable body 31. In other words, a tubular shaped supporting member 42 is installed in a standing fashion on top of the movable body 31 and the turnable body 41 is provided turnably about a vertical axis 44 with respect to the supporting member 42, by means of a bearing 43. The turning means 45 is provided inside the supporting member 42, and comprises a turning device (motor with reducing gear, or the like) 46, the upper end of which is coupled to the supporting member 42, and the lower portion of which penetrates from the movable body 31 and into the vehicle body 12, being constituted in such a manner that the upward facing output shaft 47 of the turning device 46 is coupled to the turnable body 41 by means of coupling bracket 48.

Consequently, by forward or reverse driving of the turning device 46, the turnable body 41 can be turned about the vertical axis 44 with respect to the movable body 31, by means of the output shaft 47 and the coupling bracket 48. In this case, such a construction is adopted that allows longitudinal movement of the movable body 31 to be performed via the moving means 33 described above at least partially in synchronism with the turning movement of the turnable body 41 via the turning means 45.

A fork device (one example of an article carrying body) 51 which is extendable and retractable in the longitudinal direction A is provided to be vertically movable on the turnable body 41. More specifically, the fork device 51 is composed of a base member 52, an intermediate fork member 53 which can be extended and retracted with respect to the base member 52, an upper work member 54 which can be extended and retracted with respect to the intermediate fork member 53, and an extending and retracting device (not illustrated), and the like, whereby an article W can be supported by means of the upper fork member 54.

A tubular member 56 is suspended from the lower face of the base member 52 of the fork device 51, and this tubular member 56 fits externally over a shaft shaped member 57 installed in a standing manner on the upper face of the turnable body 41. In this case, the engagement between the tubular member 56 and the shaft shaped member 57 is achieved by mutual opposition of rectangle shaped faces, the fork device 51 being vertically movable with respect to the turnable body 41, and the fork device 51 being turnable in an integrated manner with the turnable body 41. The fork device 51 is turnable about a vertical axis 44 provided closer to the rear portion thereof.

A rectangular plate shaped rotatable member 61 is fitted over the supporting member 42, and idle rollers 62 capable of rolling over the movable object 31 are provided via brackets 63 at a plurality of locations on the lower face of the rotatable member 61. Here, an idle roller 62 is provided at one position in the vicinity of the turning means 45, and an abutting plate 64 is provided on the movable body 31, onto which this idle roller 62 can ride up when the fork device 51 is turned through 90° in the forward or reverse direction.

A pair of holding frame members 65 are provided on the rotatable member 61, equidistant to either side of the turnable body 41, and pairs of linear guide mechanisms 67 are respectively provided in the lateral direction B, in upper and lower positions between a pair of front and rear bracket members 66 suspended from the lower face of the base member 52.

Elevator means 71 for raising and lowering the fork device 51 comprises a raising and lowering device (motor with reducing gear, or the like) 72 provided on the rotatable member 61, the upward facing output shaft 73 of this raising and lowering device 72 being linked to a vertically orientated screw shaft member 74 positioned between the forward linear guide mechanisms 67, in such a manner that its motion is transmitted thereto, by means of a wound transmission mechanism 75. Here, the screw shaft member 74 is supported rotatably on the holding frame member 65 by means of a bearing device 76, and a nut member 77 which screws onto the screw shaft member 74 is coupled to the forward bracket member 66.

Therefore, by causing the screw shaft member 74 to rotate forwards or in reverse, via the wound transmission mechanism 75, by forward or reverse driving of the raising and lowering device 72, the fork device 51 can be raised or lowered by means of the nut member 77 and the bracket member 66, and this raising or lowering movement is performed stably by means of the group of linear guide mechanisms 67.

A rectangular tubular shaped lower cover member 80 is installed in a standing fashion on the edge of the upper face of the vehicle body 12, in such a manner that it surrounds the moving means 33 and the turning means 45. A cover member 81 covering the fork device 51 is provided over the vehicle body 12 in such a manner that at least a portion thereof is turnable with the turnable body 41. In other words, the cover member 81 is constituted by a fixed cover section 82 provided on the front side of the vehicle body 12, a sliding cover section 83 which can slide with respect to the fixed cover section 82, and a movable cover section 84 provided on the turnable body 41.

The fixed cover section 82 is formed in a box shape which is open to the rear, by means of a front plate 82*a*, a pair of right and left-hand side plates 82*b*, a roof plate 82*c* and a base plate 82*d*, and it is provided on the front side of the vehicle body 12 by coupling the base plate 82*d* to the lower cover member 80. The sliding cover section 83 is formed in a gate fashion by means of a pair of right and left-hand side plates 83*a*, a roof plate 83*b*, and the like, and is slidable with respect to the fixed cover section 82 by means of sliding means (not illustrated), in a state where it is fitted inside the fixed cover section 82.

The movable cover section 84 is formed in a box shape which is open to the front and the lower side, by means of a rear plate 84*a*, a pair of right and left-hand side plates 84*b*, a roof plate 84*c* and a short dimension base plate 84*d*, and by connecting the short dimension base plate 84*d* to a bracket 68 installed in a standing position on the rotatable member 61; it is turnable together with the turnable body 41.

As shown in FIG. 9, an article unloading section (one example of an article handling section) 5 is formed on the lateral side of the fixed path 2. The article unloading section 5 is provided in one location or a plurality of locations. Furthermore, an article loading section, which is a further example of an article handling section, is provided in one location or a plurality of locations on the lateral side of the fixed path 2, at another position thereof. Alternatively, it is also possible to adopt a construction wherein an article handling section which functions both as an article unloading section and an article loading section is provided in one location or a plurality of locations.

Below, the action of the first embodiment described above is explained.

Figure 4:
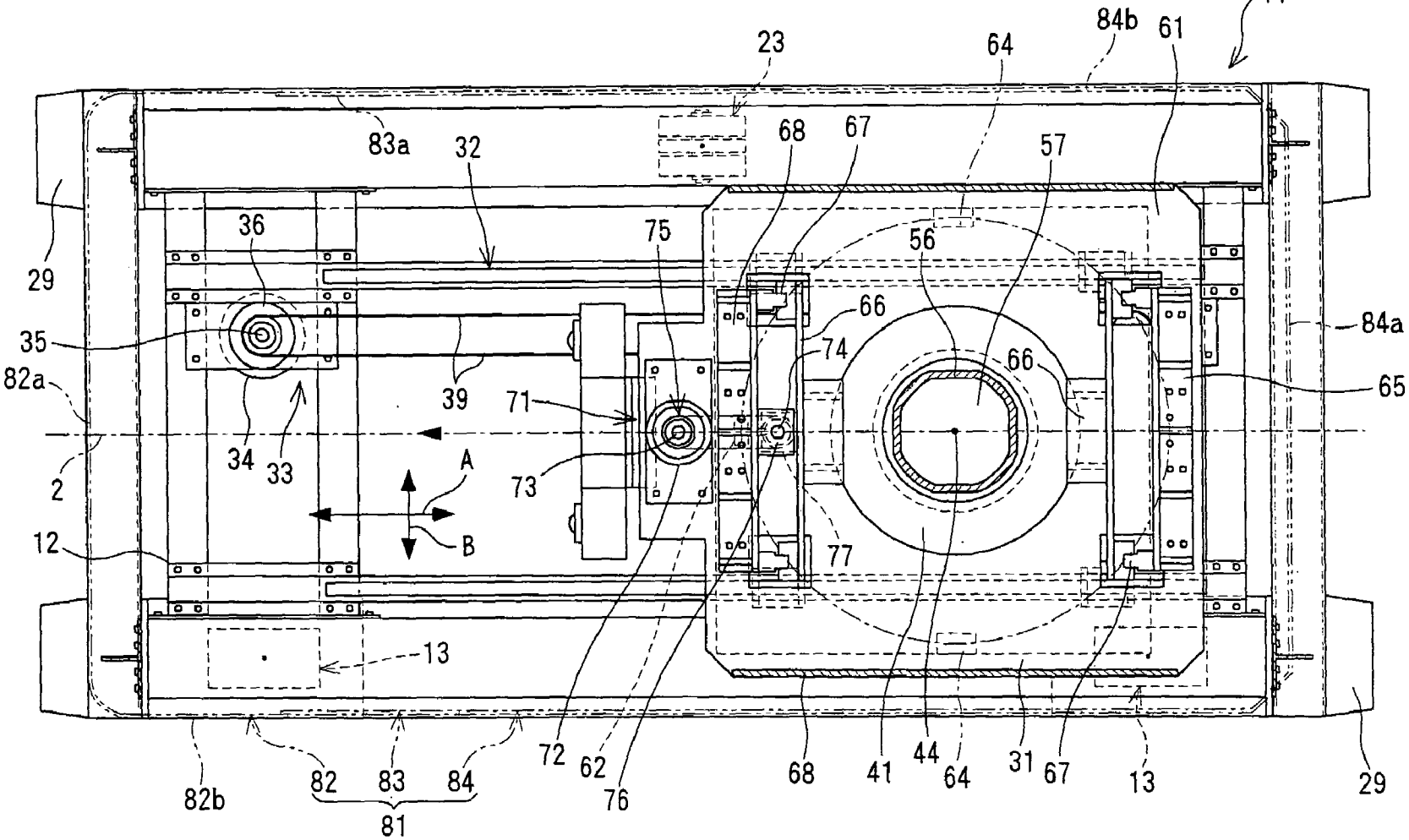
FIG. 4 is a sectional plan view of a turnable body portion of the self-propelled carriage.
Figure 5:
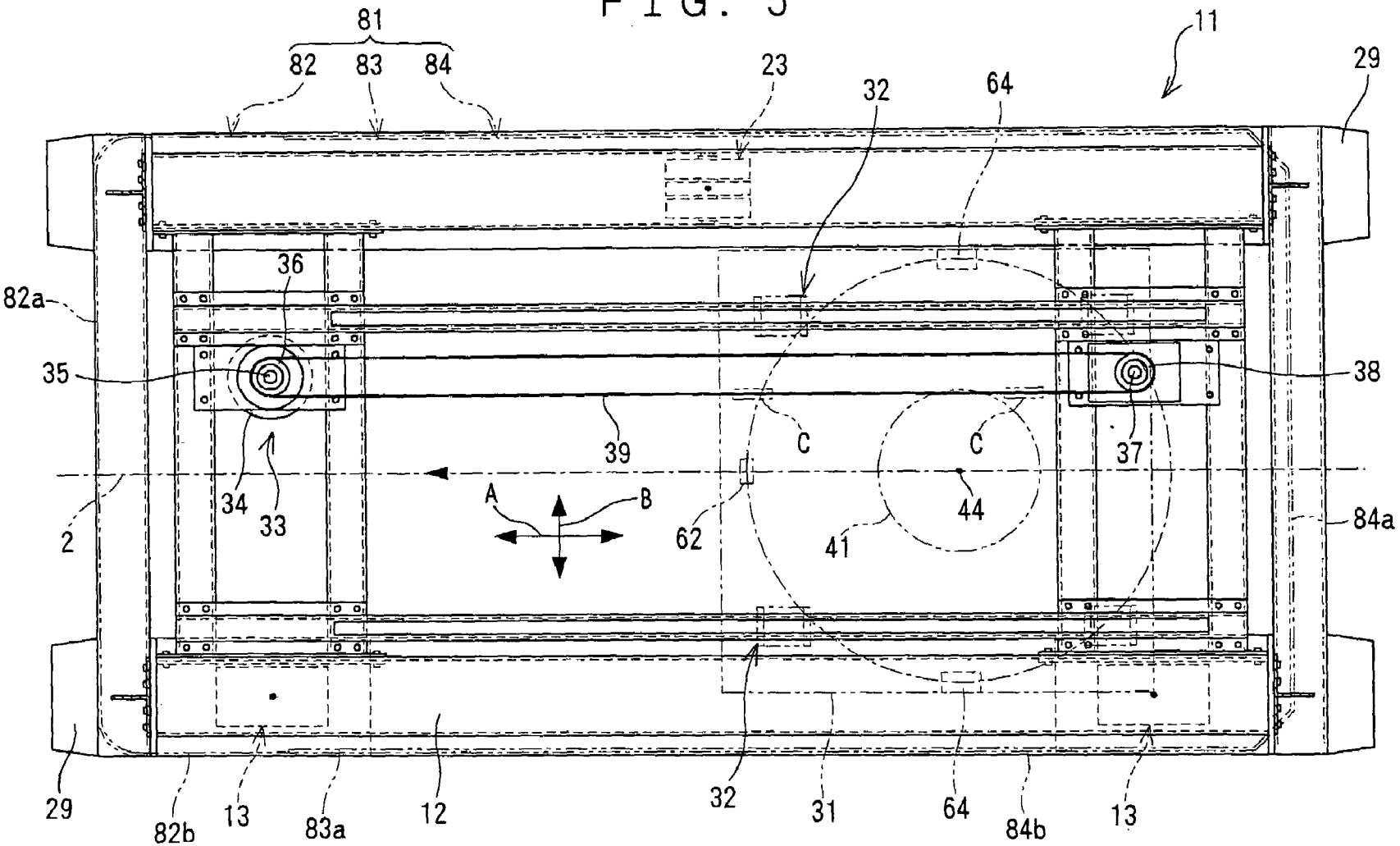
FIG. 5 is a sectional plan view of a moving means portion of the self-propelled carriage.
Figure 6:
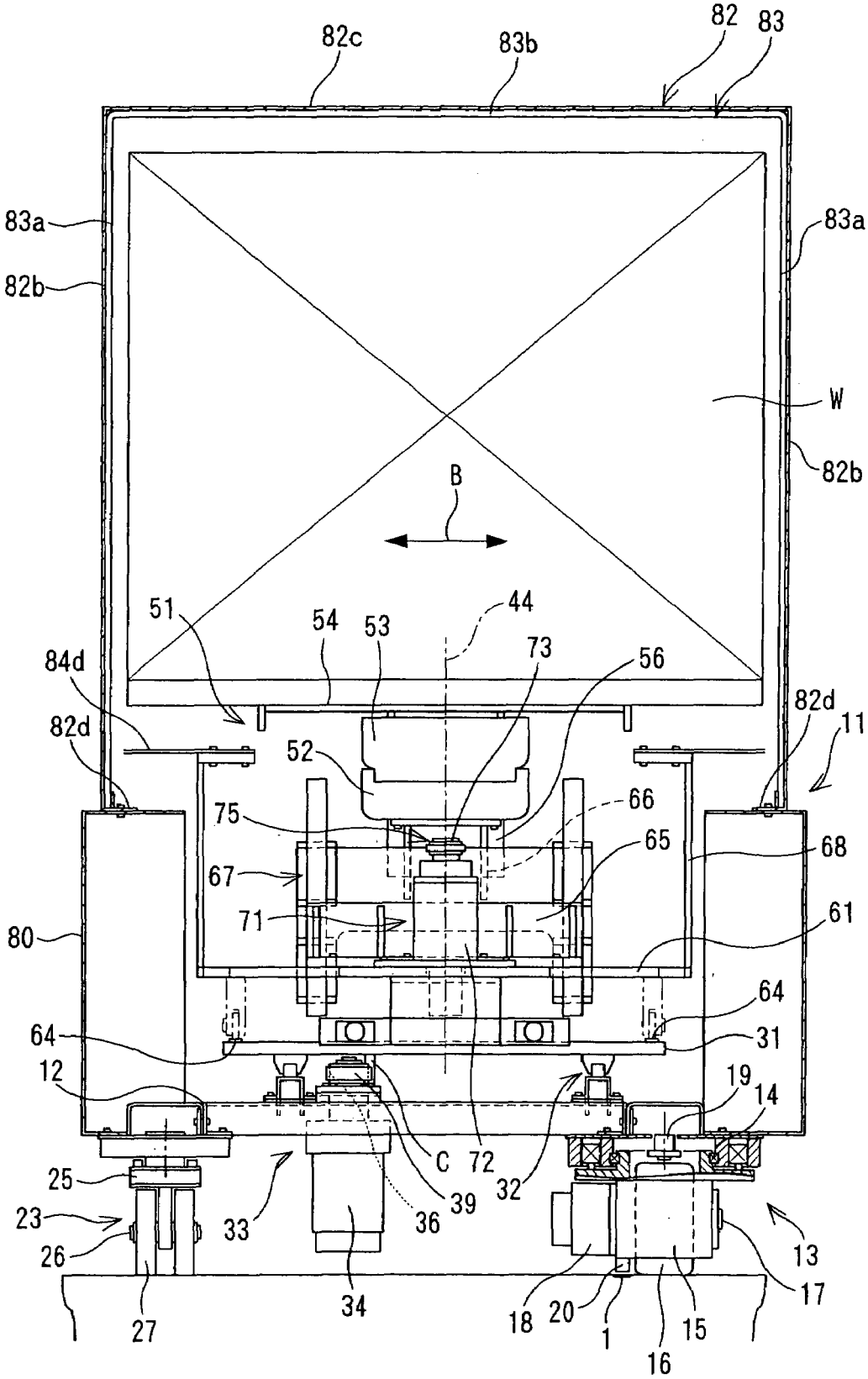
FIG. 6 is a partially cutaway front view of a fixed cover section of the self-propelled carriage.
Figure 7:
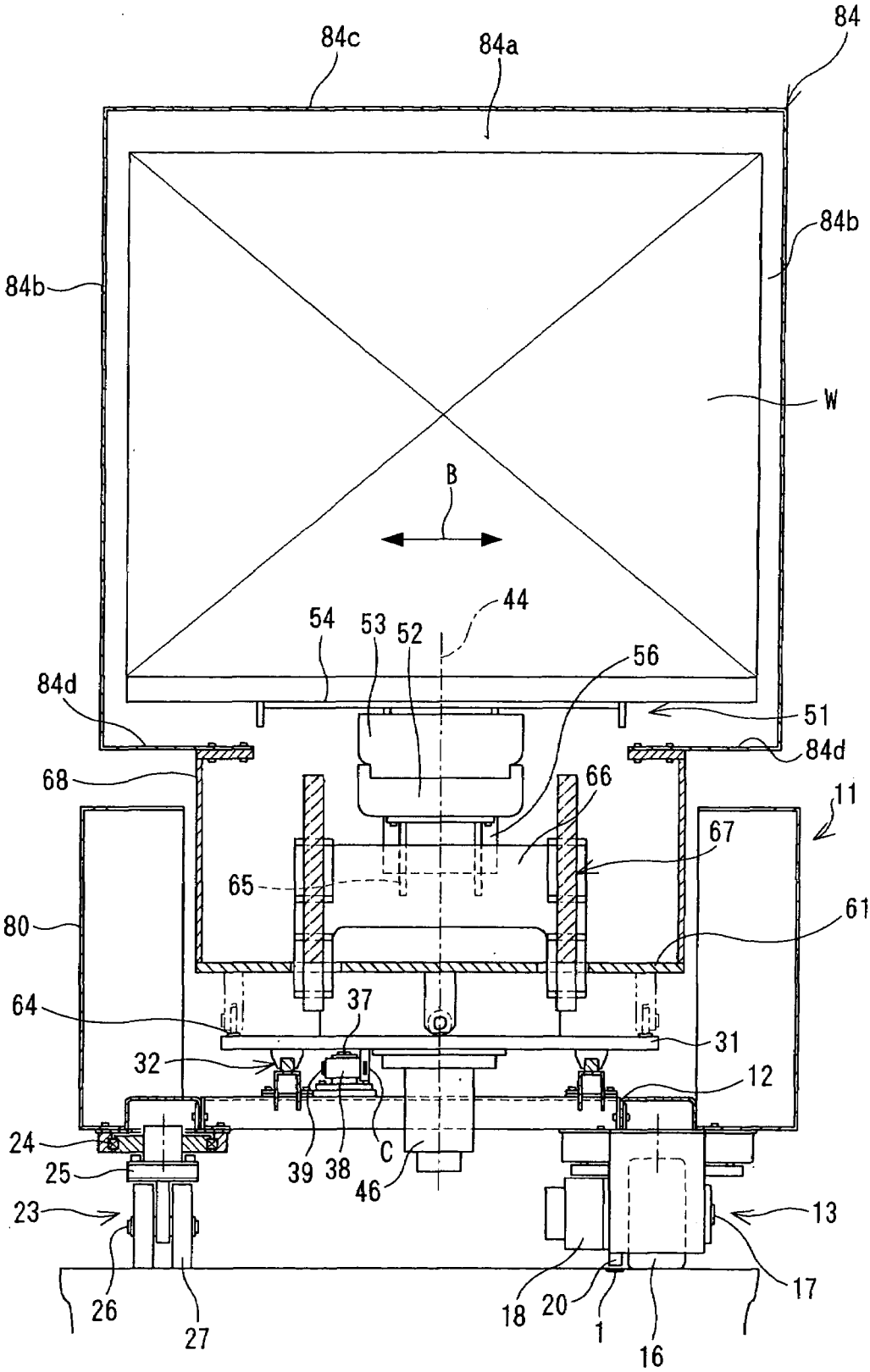
FIG. 7 is a partially cutaway front view of a movable cover section of the self-propelled carriage.

For example, in a state where an article W has been loaded onto the self-propelled carriage 11 in the article loading section, the movable body 31 of the self-propelled carriage 11 is moved to the rear side, as illustrated in FIG. 1 and FIG. 4, and the lowered fork device 51 is turned to face in the longitudinal direction, and the article W is supported by the extended upper fork member 54. Furthermore, the sliding cover section 83 of the cover member 81 is caused to project and slide with respect to the fixed cover section 82, the front end thereof abuts against or interlocks with the movable cover section 84, and finally, the article W, or the like, is positioned inside the closed cover member 81.

In a state of this kind, the self-propelled carriage 11 travels along the fixed path 2. In other words, when the article unloading section 5 of the next destination sends an instruction to a controller, with respect to the self-propelled carriage 11, via a communications device, the controller establishes a route for arriving at the destination article unloading section 5, and then outputs a drive instruction to the drive motor 18 of the driving wheels 16 to drive the self-propelled carriage 11. In this case, the self-propelled carriage 11 travels by detecting the induction belt 1 by means of a guide sensor 20 and controlling its steering direction by means of independent control. When information relating to a mark of the article unloading section 5 is read in, the self-propelled carriage 11 moves at low speed, and eventually, it halts at a desired position of the article unloading section 5, as illustrated in FIG. 9(*a*).

In this way, with the self-propelled carriage 11 being halted alongside the desired article unloading section 5, the sliding cover section 83 is slid and retracted with respect to the fixed cover section 82, and an open section of a prescribed length is formed between the front end thereof and the movable cover section 84. In this state, the turning means 45 is operated and the turnable body 41 is caused to turn about the vertical axis 44. In this case, the rotatable member 61 turns in an integrated manner about the vertical axis 44, via the shaft shaped member 57, tubular member 56, base member 52, bracket member 66, linear guide mechanisms 67, and the like.

Figure 8:
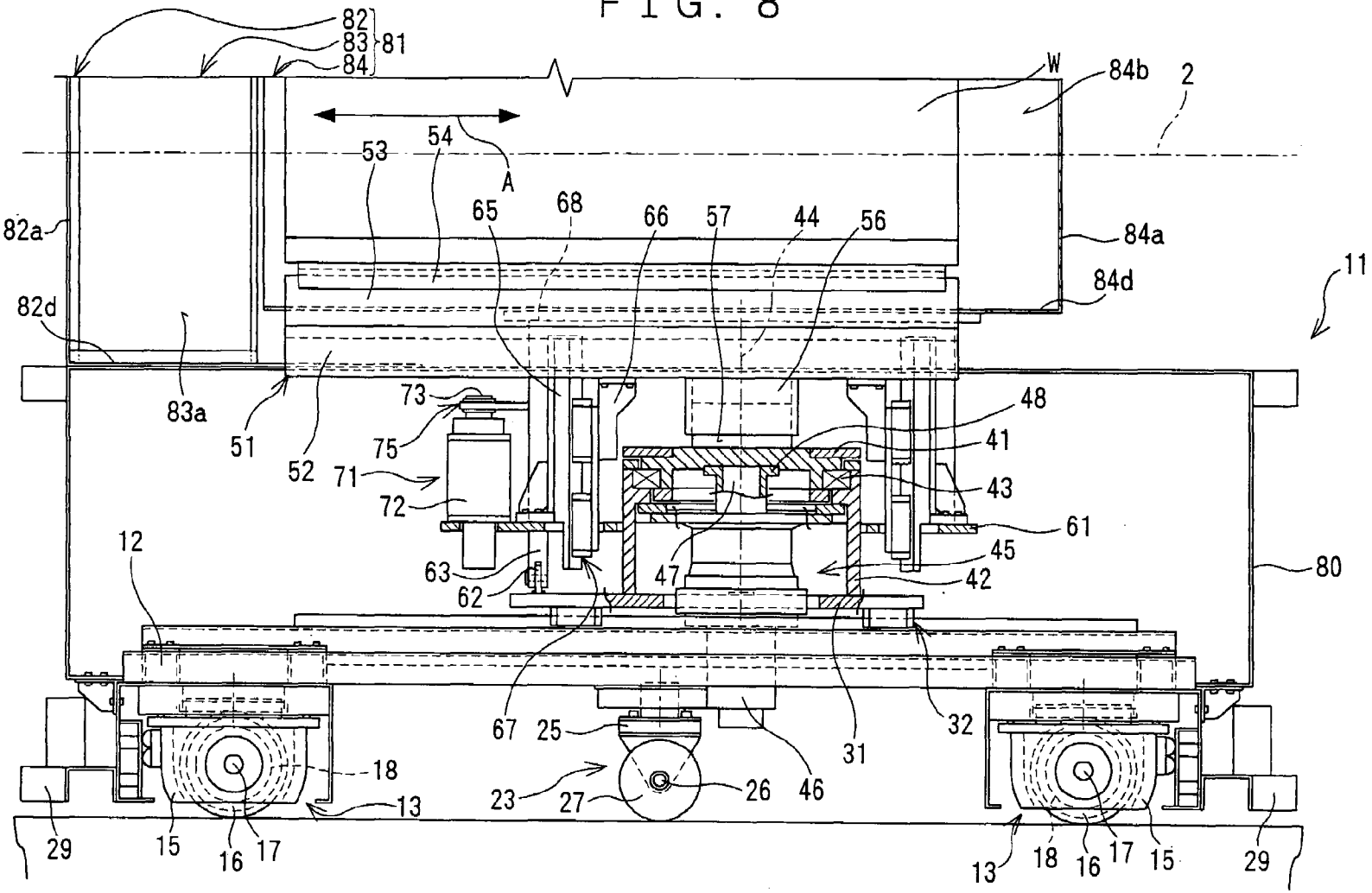
FIG. 8 is a partially cutaway side view of the self-propelled carriage, in a state where the movable body has been moved frontward.
Figure 9A:
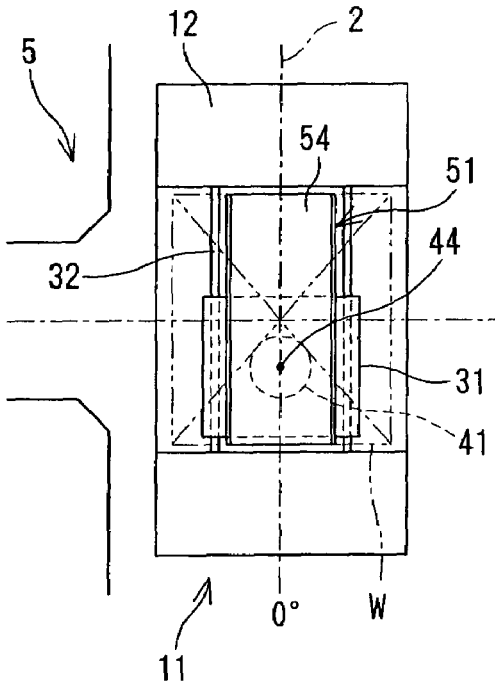
FIGS. 9(*a*)–9(*d*) are a schematic plan view showing a series of operations in a first half of the article transfer method using the self-propelled carriage.
Figure 9B:
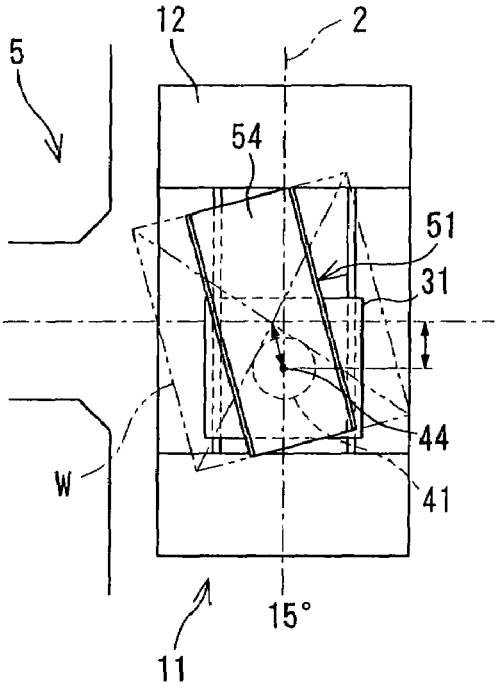
Figure 9C:
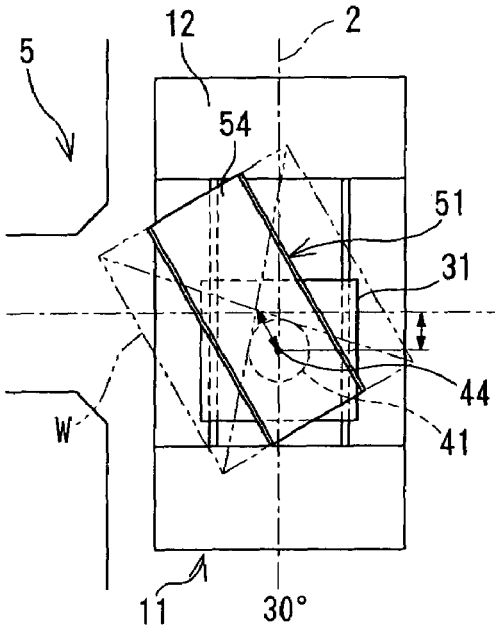
Figure 9D:
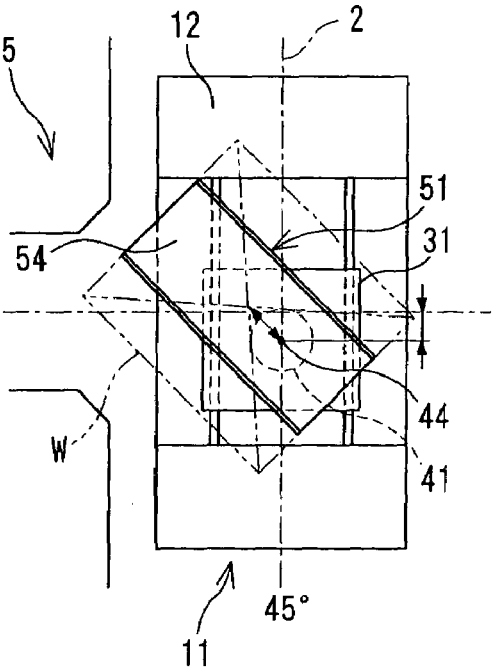
Figure 10A:
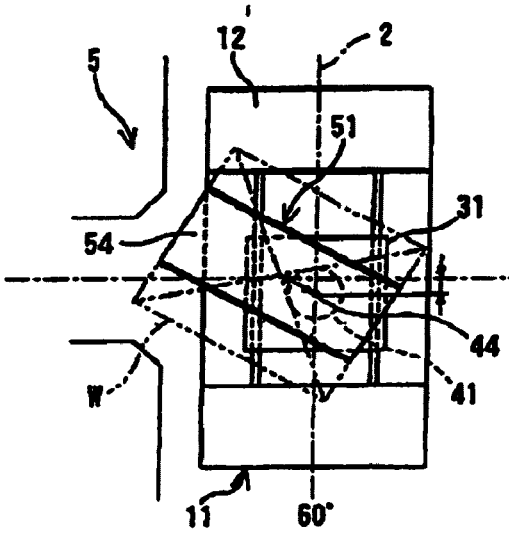
FIGS. 10(*a*)–10(*d*) are a schematic plan view showing a series of operations in a latter half of the article transfer method using the self-propelled carriage.
Figure 10B:
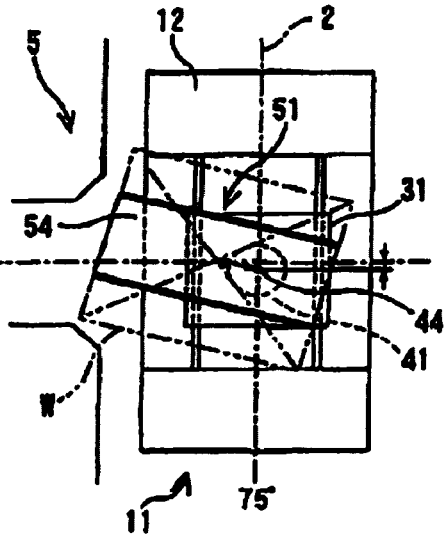
Figure 10C:
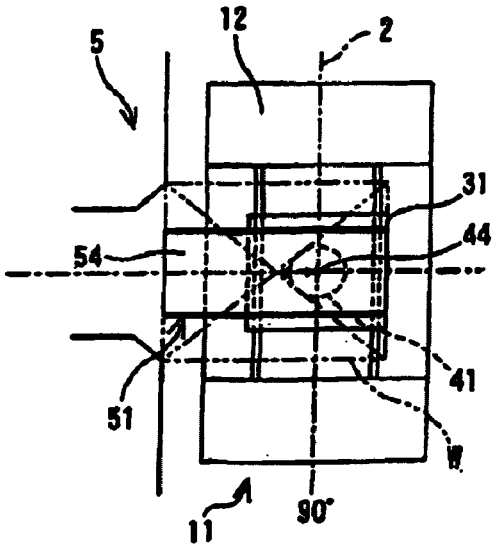
Figure 10D:
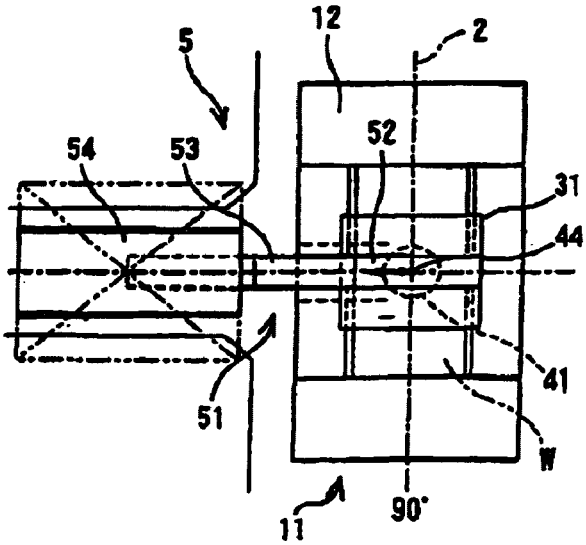
Figure 11A:
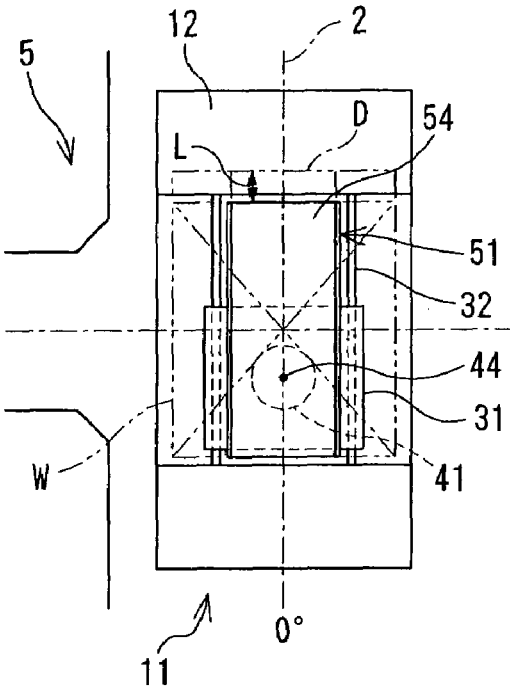
FIGS. 11(*a*)–11(*d*) are a schematic plan view showing a series of operations in a first half of the article transfer method using the self-propelled carriage according to a second embodiment of the present invention.
Figure 11B:
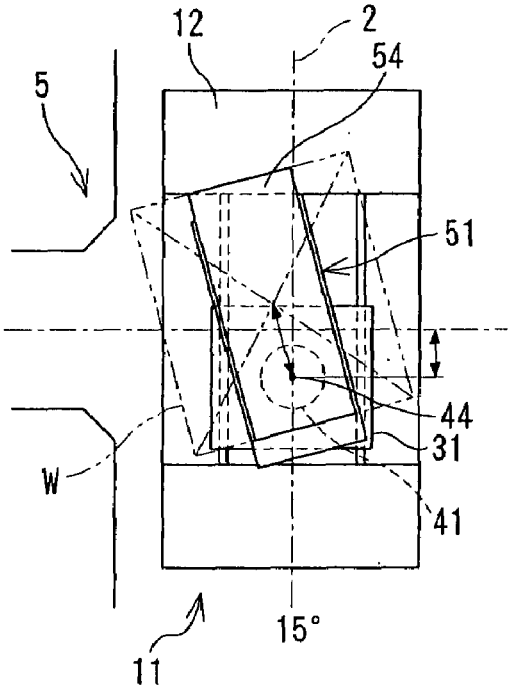
Figure 11C:
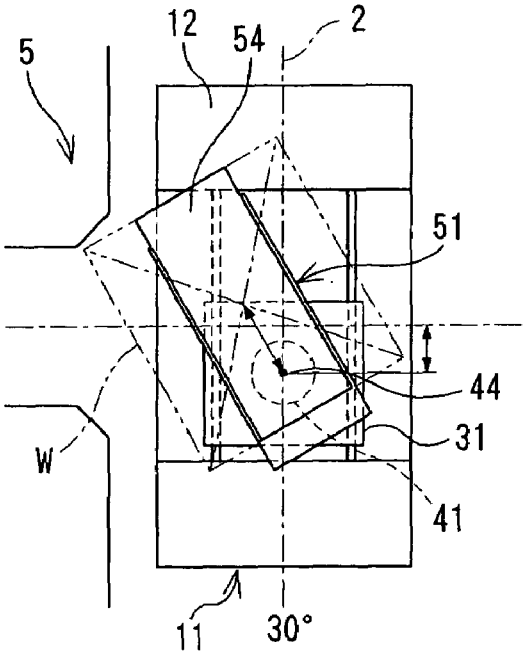
Figure 11D:
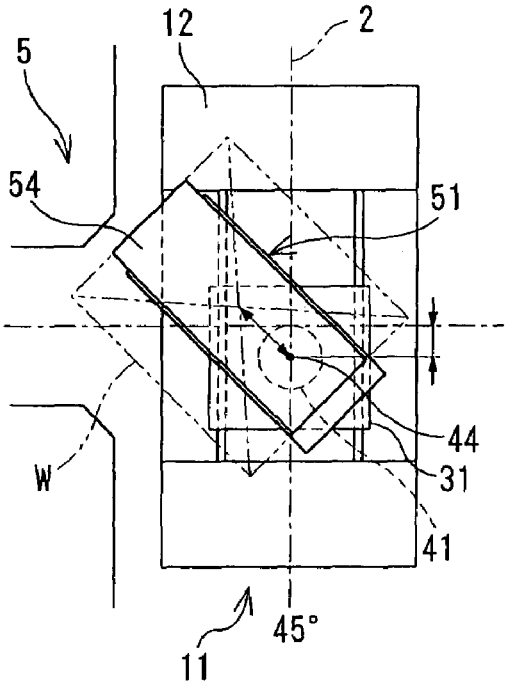
Figure 12A:
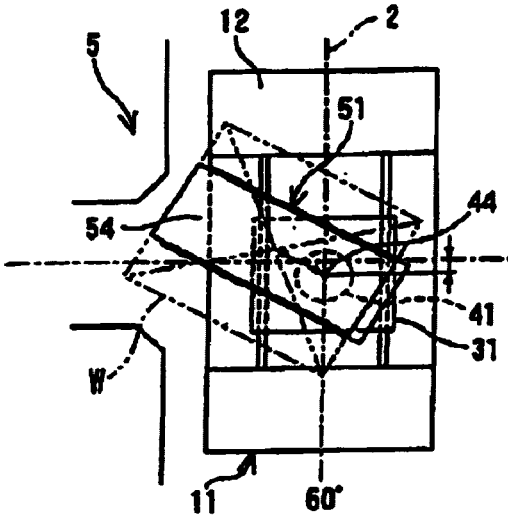
FIGS. 12(*a*)–12(*d*) are a schematic plan view showing a series of operations in a latter half of the article transfer method using the self-propelled carriage.
Figure 12B:
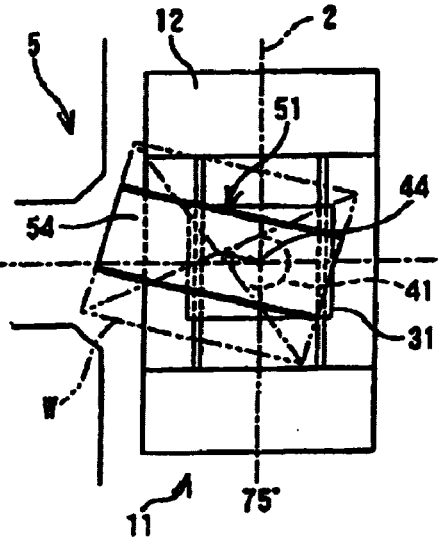
Figure 12C:
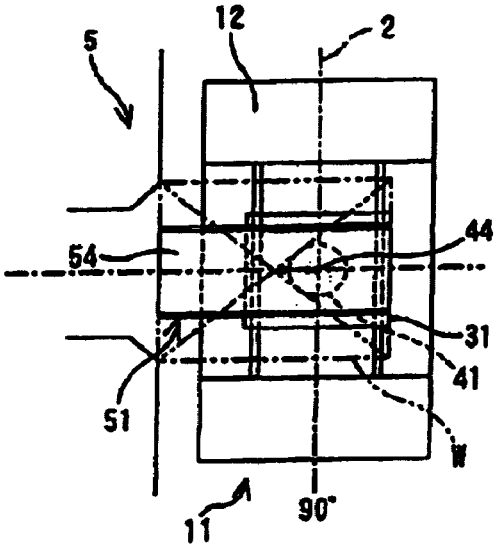
Figure 12D:
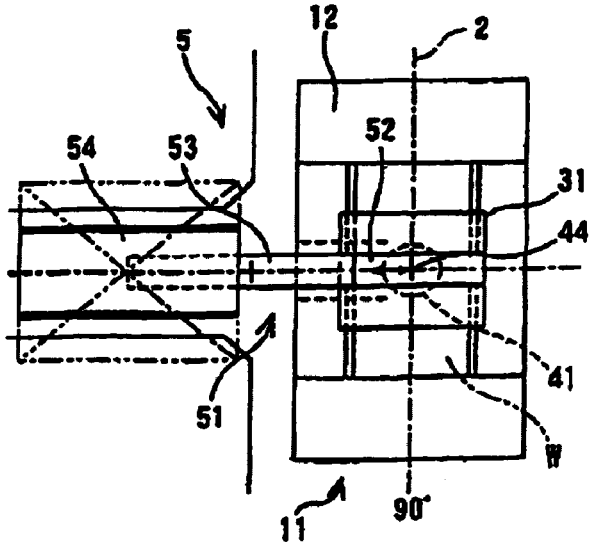

More specifically, firstly, as illustrated in FIG. 9(*a*) and FIG. 9(*b*), the turnable body 41 is initially turned (from 0° to approximately 15°) about the vertical axis 44, and the front end of the fork device 51 is made to face the article unloading section 5. Thereupon, whilst the turnable body 41 continues to turns about the vertical axis 44, the moving means 33 is actuated, and the movable body 31 is caused to move towards the front end of the vehicle body 12, as illustrated in FIG. 8. In other words, the movable body 31 (vertical axis 44) performs a forward movement in a synchronised manner with the turning movement of the turning member 41 (from approximately 15° to 90°), as sequentially illustrated in FIG. 9(*b*), FIG. 9(*c*), FIG. 9(*d*), FIG. 10(*a*), FIG. 10(*b*) and FIG. 10(*c*).

Thereby, as illustrated in FIG. 10(*c*), the front end of the fork device 51 is made to face the article unloading section 5 in a perfectly lateral state. The rotation of the rotatable member 61 is performed stably by means of the idle rollers 62 rolling over the movable body 31, and positional registration of the turning motion such that the front end of the fork device 51 facing in a perfectly lateral direction is achieved by means of the idle roller 62 riding up onto the abutting plate 64.

Thereupon, the article W supported by the upper fork member 54 is transferred (unloaded) to the article unloading section 5, by means of combined operations of raising or lowering the fork device 51 by actuating the raising and lowering means 71, and retracting the fork device 51. This is shown in FIG. 10(*d*).

Thereupon, by means of a set of operations reverse to those described above, in other words, by means of sequential operations shown in FIG. 10(*c*), FIG. 10(*b*), FIG. 10(*a*), FIG. 9(*d*), FIG. 9(*c*) and FIG. 9(*b*), the fork device 51 containing the empty upper fork member 54 is accommodated over the vehicle body 12, as illustrated in FIG. 9(*a*), thereby completing the task of unloading the article W onto the article unloading section 5. Incidentally, a task of loading an article W by means of the fork device 51 in an article loading section, for example, can be performed by the set of operations reverse to those described above.

With the article handling task of this kind, the fork device 51 can be turned without rightward or leftward movement of the fork device 51, which forms the final operating section, and with a small amount of protrusion towards the article unloading section 5, by means of combined operations of forward and rearward movement of the movable body 31, and turning movement of the turnable body 41 with respect to the movable body 31.

Next, a second embodiment of the present invention is described with reference to FIG. 11 and FIG. 12. In this second embodiment, a self-propelled carriage 11 similar to that of the first embodiment described above is used.

Specifically, as shown in FIG. 11(*a*), with the self-propelled carriage 11 in a halted state alongside a desired article unloading section 5, the sliding cover section 83 is slidingly extended or retracted with respect to the fixed cover section 82, thereby forming an open section of a prescribed length between the front end thereof and the movable cover section 84. In this state, firstly, the fork device 51 is caused to project, and the front end section of the upper fork member 54 is caused to project by a prescribed projection distance L, as illustrated by the broken line D in FIG. 11(*a*). Here, the projection distance L is set so that the fork device 51 (article W) is allowed to turn by an open space of the prescribed length.

Next, turning means 45 is actuated and the turnable body 41 is turned about the vertical axis 44. Here, a rotatable member 61 is turned in an integrated manner about the vertical axis 44, via a shaft shaped member 57, tubular member 56, base member 52, bracket member 66 and linear guide mechanisms 67, and the like.

In other words, the turnable body 41 is initially turned (from 0° to approximately 15°) about the vertical axis 44, as illustrate in FIG. 11(*a*) and FIG. 11(*b*), thereby causing the front end of the fork device 51 to face the article unloading section 5. As the turnable body 41 continues to turn in an intermediate region (from approximately 15° to approximately 75°) about vertical axis 44, moving means 33 is actuated and causes the movable body 31 to move towards the front end of the vehicle body 12, in addition to which the fork device 51 is withdrawn (retracted). In other words, a forward movement of the movable body 31 (vertical axis 44) and a retracting movement of the fork device 51 are performed simultaneously, during the intermediate region of turning of the turnable body 41, as sequentially illustrated in FIG. 11(*b*), FIG. 11(*c*), FIG. 11(*d*), FIG. 12(*a*) and FIG. 12(*b*).

When the forward movement of the movable body 31 and the retracting movement of the fork device 51 are halted (completed), the turnable body 41 makes a final turn (from approximately 75° to 90°) about the vertical axis 44, as illustrated in FIG. 12(*b*) and FIG. 12(*c*). Thereby, as illustrated in FIG. 12(*c*), the front end of the fork device 51 is made to face the article unloading section 5 in a perfectly lateral fashion.

Subsequently, the article W supported on the upper fork member 54 is transferred (unloaded) onto the article unloading section 5, by means of combined operations of raising and lowering the fork device 51 via operation of the raising and lowering means 71, and of extending and retracting the fork device 51. This is depicted in FIG. 12(*d*).

Thereupon, by means of a set of operations reverse to the foregoing, in other words, by following sequential operations as illustrated in FIG. 12(*c*), FIG. 12(*b*), FIG. 12(*a*), FIG. 11(*d*), FIG. 11(*c*) and FIG. 11(*b*), the fork device 51 having an empty upper fork member 54 is accommodated over the vehicle body 12, as illustrated in FIG. 11(*a*), and the task of unloading the article W onto the article unloading section 5 is finally completed. Incidentally, an article W can be loaded onto the fork device 51 in an article loading section, for example, by means of the set of operations reverse to the foregoing.

With an article handling task of this kind, it is possible to perform turning of the fork device 51 without rightward or leftward movement of the fork device 51, which forms the final operating section, and with a small amount of protrusion towards the article unloading section 5, by means of combined operations of forward and backward movement of the movable body 31, turning movement of the turnable body 41 with respect to the movable body 31, and extending or retracting movement of the fork device 51 with respect to the turnable body 41.

In the first and second embodiments described above, a trackless self-propelled carriage is described as the self-propelled carriage 11 capable of travelling along a fixed path 2, but this carriage may also be of such a type that a carriage can travel along a fixed path 2 by having a group of wheels which are supported and guided by a rail device, or it may be of another type such that a carriage can travel along a fixed path 2 by having a guide device provided on the vehicle which is guided by a guide rail.

In the first and second embodiments described above is a self-propelled carriage 11 comprising two driving wheel devices 13 and one driven wheel device 23 was described, but the number and positional location of the driving wheel devices 13 and driven wheel devices 23 may be set as desired.

In the first and second embodiments described above, a fork device 51 which can be extended and retracted in the forward and rearward direction is as an article supporting body, but it is also possible to use a conveyor type article supporting body comprising a chain or roller, or the like, in which case, a similar constitution be applied to the article handling section.

In the first and second embodiments described above, a construction was described wherein a cover member 81 for covering the fork device 51 is provided over the vehicle body 12 in such a manner that at least a portion thereof is turnable in unison with the turnable body 41, but it is also possible to adopt a construction wherein the whole of a cover member having an opening and closing door is provided turnably in unison with the turnable body 41, or a construction wherein the cover member 81 is omitted.

What is claimed is:

1. A self-propelled carriage eomprising a carriage body and a movable body capable of moving in a longitudinal direction with respect to the carriage body, and moving means, attached to said carriage body said movable body comprising a turnable body turnable about a vertical axis, and turning means having an article supporting body mounted over said turnable body, wherein:

the movable body performs a longitudinal movement whilst the turnable body performs a turning movement in a synchronised manner; and a cover member for covering the article supporting body located on top of the carriage body such that a portion of said carriage body is turnable in unison with the turnable body, and the cover member comprises a fixed cover section located on the front end of the carriage body, a sliding cover section capable of sliding with respect to the fixed cover section and a movable cover section capable of turning in unison with the turnable body.

2. The self-propelled carriage according to claim 1, wherein the article supporting body is a fork device extendable and retractable in forward and backward directions.

* * * * *